US007810998B2

(12) United States Patent
Williams

(10) Patent No.: US 7,810,998 B2
(45) Date of Patent: Oct. 12, 2010

(54) MULTI-HANDLE UTILITY BAG

(76) Inventor: Matthew Williams, 2430 NE. Ct., Lighthouse Point, FL (US) 33064

( * ) Notice: Subject to any disclaimer, the term of this patent is extended or adjusted under 35 U.S.C. 154(b) by 747 days.

(21) Appl. No.: 11/714,713

(22) Filed: Mar. 5, 2007

(65) Prior Publication Data

US 2007/0242904 A1 Oct. 18, 2007

Related U.S. Application Data

(60) Provisional application No. 60/779,069, filed on Mar. 3, 2006.

(51) Int. Cl.
*B65D 33/06* (2006.01)
*B65D 30/00* (2006.01)
*B65D 85/28* (2006.01)

(52) U.S. Cl. ..... 383/16; 383/121.1; 206/372

(58) Field of Classification Search ..... 383/6, 383/16, 21, 18, 121.1; 206/372, 373
See application file for complete search history.

(56) References Cited

U.S. PATENT DOCUMENTS 616,249 A * 12/1898 Nickerson ..... 383/16
724,316 A * 3/1903 Morris et al. ..... 383/18
733,542 A * 7/1903 Converse ..... 383/16
3,185,342 A * 5/1965 Gottsegen et al. ..... 220/770
3,306,329 A * 2/1967 Braun ..... 220/9.2
4,248,364 A * 2/1981 Anderson ..... 383/6
5,620,069 A * 4/1997 Hurwitz ..... 190/107
5,653,318 A * 8/1997 Field ..... 190/18 R
5,954,193 A 9/1999 Bartee
6,161,665 A 12/2000 Hoover
6,213,268 B1 4/2001 Dancyger
6,293,418 B1 9/2001 Ogden et al.
6,478,463 B2 * 11/2002 Snider ..... 383/18
D474,891 S 5/2003 Huang
D506,060 S 6/2005 Achilles
6,920,993 B2 7/2005 Sheng-Bin
2002/0015538 A1 2/2002 Snider
2004/0149600 A1 * 8/2004 Wolter et al. ..... 206/223
2006/0201979 A1 9/2006 Achilles
2007/0025647 A1 * 2/2007 Hamlin ..... 383/14
2007/0241014 A1 * 10/2007 Williams ..... 206/373
2007/0241113 A1 * 10/2007 Williams ..... 220/500

* cited by examiner

*Primary Examiner*—Jes F Pascua
(74) *Attorney, Agent, or Firm*—Novak Druce+Quigg; J. Rodman Steele, Jr.; Gregory M. Lefkowitz

(57) ABSTRACT

A multi-handle utility bag comprising a durable outer body and underframe, multiple handles, and a series of externally-disposed pockets. Extending from the peripheral lip or mouth of the bag are two pairs of diametrically-opposed handles, wherein the first pair of handles enables single-person carriage of the bag, whereas the second pair of handles enables, at a minimum, two-person in-line or side-by-side carriage of the bag.

8 Claims, 4 Drawing Sheets

MULTI-HANDLE UTILITY BAG

RELATED APPLICATIONS

The present Nonprovisional Application is related to, and hereby claims priority to and the benefit of, U.S. Provisional Application No. 60/779,069, entitled "Multi-Handle Utility Bag," filed on Mar. 3, 2006.

TECHNICAL FIELD

The present invention relates generally to tool bags, and more specifically to a multi-handle utility bag that conveniently and comfortably enables multi-person in-line or side-by-side carriage of the bag.

BACKGROUND OF THE INVENTION

Utility bags are commonly employed by construction workers, mechanics, service technicians, and the like, to conveniently store and transport a variety of tools necessary in the performance of their respective trades. As would be expected, most such utility bags are manufactured from selected heavy duty fabrics and rigid internal support frames that imbue the bag with engineer-specific performance characteristics, such as high load capacity, tear resistance, puncture resistance, water resistance, and other physical properties that collectively strengthen and increase overall utility of the bag. Accordingly, such bags are adapted to withstand the abuse of being tightly packed or otherwise heavily loaded with an array of bulky power tools, hand tools, and miscellaneous hardware.

Additionally, to facilitate the transport of such bags, most are equip with two high-load capacity handles, generally disposed on opposing sides of the bag, and proximate the peripheral lip or mouth thereof. However, if the bag has been heavily loaded with selected tools, a single user may experience significant difficulty or fatigue in either picking up or transporting the bag. In most such instances, the user will often employ the use of both hands to grasp the two handles of the bag, and attempt to heave the bag along side his legs, or directly in front and against his legs, the latter method taking advantage of strength and inertia provide via forward leg momentum. Unfortunately, either method of transport may contribute to acute or long-term muscle strain or joint injury. Although, the user may request the assistance of another person, such dual-handle bags are not structurally conducive to comfortable multi-person carriage.

Specifically, although two users, positioned side-by-side, may each grasp a single handle of a dual-handle bag, such that the bag is position between each user, the resulting method of transport forces the users to shimmy along side one another, while the heavy, tool-filled bag uncomfortably and painfully knocks against the sides of the users' legs or knees.

Therefore, it is readily apparent that there is a need for a multi-handle utility bag that provides two pairs of diametrically-opposed handles, wherein the first pair of handles enables single-person carriage of the bag, whereas the second pair of handles enables convenient and comfortable two-person in-line or side-by-side carriage of the bag; thereby, avoiding the above-referenced disadvantages associated with conventional dual-handle bag configurations.

BRIEF SUMMARY OF THE INVENTION

Briefly described in a preferred embodiment, the present invention overcomes the above-mentioned disadvantages, and meets the recognized need for such an invention by providing a multi-handle utility bag comprising a durable outer body and underframe, multiple handles, and a series of externally-disposed pockets. Extending from the peripheral lip or mouth of the bag is a first pair of opposingly-disposed handles that enables the convenient single-person carriage of the bag. A second pair of handles, also extending from the peripheral lip or mouth of the bag, enables, at a minimum, two-person carriage of the bag, wherein the two persons may be positioned in a forward-to-rearward fashion (i.e., in-line) or an adjacent fashion (i.e., side-by-side) during carriage of the bag.

According to its major aspects and broadly stated, the present invention in its preferred form is a multi-handle utility bag comprising an outer body, underframe, multiple handles, a series of exteriorly-disposed pockets and, optionally, a series of interiorly-disposed pockets, compartments or other structures for selective sequestration of bag contents.

More specifically, the present invention is a multi-handle utility bag comprising a substantially rigid underframe over which is formed or otherwise disposed a durable outer body that provides the bag with a generally rectangular structural configuration, similar to a utility or tool box, and a large open mouth for ease of placement and access to tools therewithin. Preferably extending from the opposing long-sides of the bag, proximate the peripheral lip of the bag mouth, is a first pair of opposingly-disposed handles, each formed from a pliable, high-load capacity fabric, and preferably utilized for convenient single-person carriage of the bag. However, preferably disposed proximate to the opposing short-sides of the bag, and further proximate the peripheral lip of the bag mouth, is a second pair of opposingly-disposed handles, each formed instead from a substantially rigid, molded substrate, and preferably utilized for multi-person carriage of the bag.

That is, when the utility bag has be heavily loaded, such that at least two individuals are now required to lift and transport same, the second pair of handles may be utilized by these individuals to accomplish the task. As such, the two individuals may each grasp one handle of this second pair, wherein the two individuals may be positioned in either a forward-to-rearward fashion (i.e., in-line or one in front of the other) and either face away or face each other, or an adjacent fashion (i.e., side-by-side), during carriage of the bag. In instances where side-by-side carriage of the bag is employed, the bag may be carried such that a first handle of the second pair of handles is grasped within the right hand of the first individual, and the second handle of the second pair of handles is grasped within the left hand of the second individual. However, it should be recognized that users of the present invention are not limited to carriage of the utility bag in accordance with the foregoing methods of transport, but, instead, may employ any method of transport or carriage of the present utility bag that best suits the user's physical circumstances.

The utility bag of the present invention still further provides a series of open pockets, flap-covered pockets, and other side compartments disposed on the exterior walls of the bag body. Additionally, bungee-straps disposed overtop selected side pockets or compartments are provided for removably-securing loose items therewithin. The bag may further comprise any number or series of interiorly-disposed pockets, compartments and other structures for convenient containment of miscellaneous loose hardware (i.e., drill bits, nails, small hand tools, etc.).

Accordingly, a feature and advantage of the present invention is its ability to provide a multi-handle utility bag.

Another feature and advantage of the present invention is its ability to provide a utility bag comprising two pairs of diametrically-opposed handles.

Still another feature and advantage of the present invention its ability to provide a utility bag comprising a first pair of handles that enables single-person carriage of the bag, and a second pair of handles that enables two-person in-line or side-by-side carriage of the bag.

Yet another feature and advantage of the present invention is its ability to provide a utility bag comprising a first pair of pliable handles and a second pair of rigid handles.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

In describing the preferred and selected alternate embodiments of the present invention, as illustrated in FIGS. 1-4, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
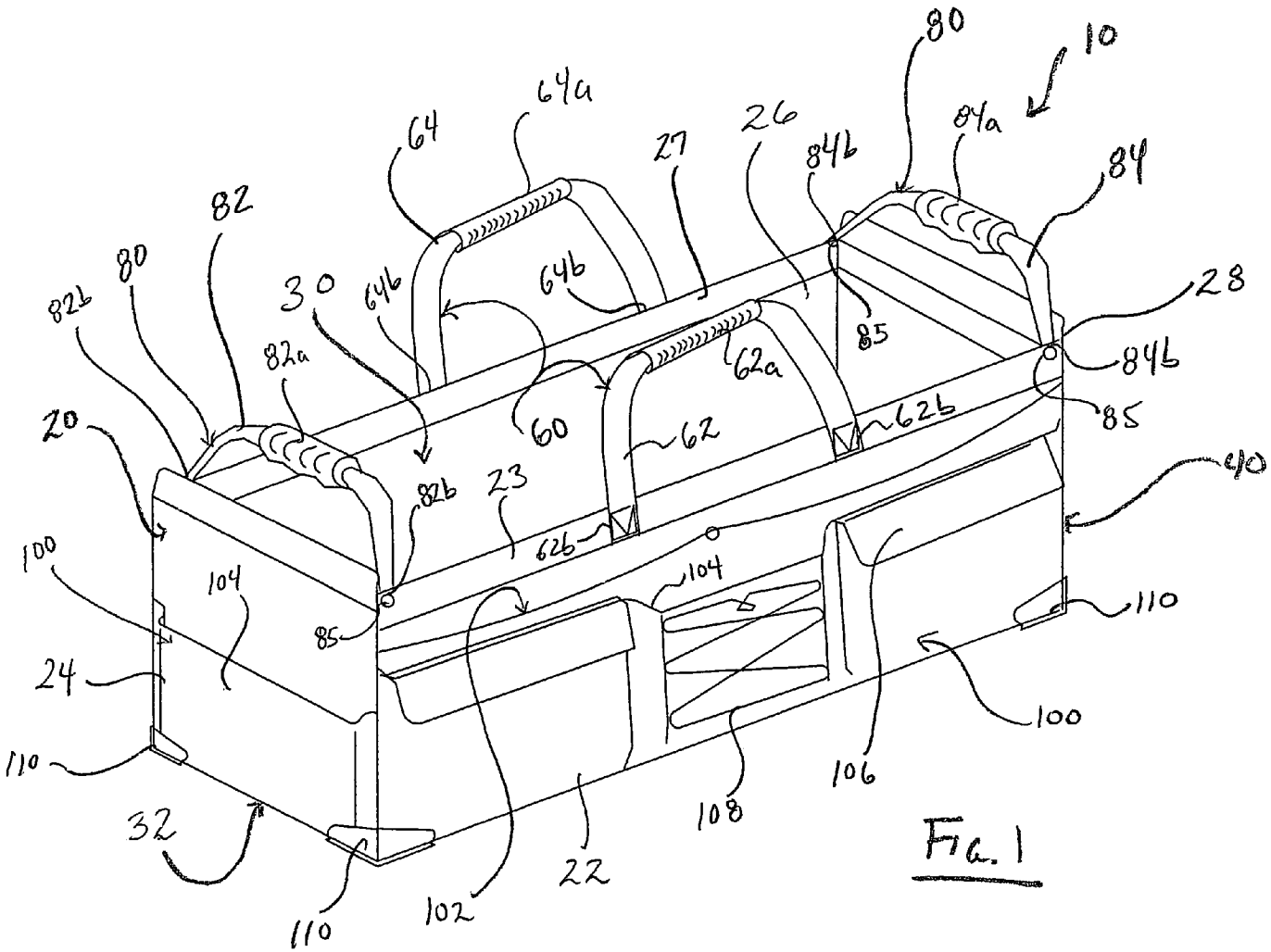
FIG. 1 is a perspective view of a multi-handle utility bag.

Referring generally now to FIG. 1, the present invention in its preferred embodiment is a multi-handle utility bag 10, comprising outer body 20, underframe 40, first pair of handles 60, second pair of handles 80, and pockets 100.

Generally, outer body 20 is preferably formed or otherwise disposed over underframe 40 to provide bag 10 with a substantially rectangular structural configuration characterized by sidewalls 22, 24, 26, 28, open mouth 30, and rigid closed bottom or underside 32 (i.e., similar to a utility or tool box). As such, large open mouth 30 enables ease of placement and access to tools contained within bag 10, and rigid underside 32 provides effective and durable support for items placed within bag 10.

More specifically, underframe 40 of bag 10 may comprise any rigid structure, including, without limitation, metal frames, molded metal shells, rigid plastic frames, molded plastic shells (ex., HMW polyethylene shells), molded bio-foam, molded vinyl, vinyl sheeting, metal sheeting, wood sheeting, stiff fiber board, metal mesh, plastic mesh, or the like. In any instance, however, underframe 40 is preferably utilized to reinforce and/or form, in part or in whole,. the underlying framework of sidewalls 22, 24, 26, 28, and/or underside 32, over which outer body 20 is formed or disposed.

As generally described hereinabove, outer body 20 is preferably formed or otherwise disposed over underframe 40. However, the selected manufacturing process for securing outer body 20 over or to underframe 40 is largely a function of the fabrics, materials or substrates utilized to form outer body 20. As such, depending upon the selected fabrics, materials or substrates, outer body 20 may be stitched, riveted, and/or integrally formed with, underframe 40. Although a variety of high-grade materials, fabrics, and other substrates may be utilized to form outer body 20, the present invention seeks to endow bag 10 with high strength and rugged durability and, as such, contemplates the manufacture of outer body 20 from, without limitation, nylon (ex., double layered 1000 denier DUPONT CORDURA PLUS nylon, nylon yarn N-56, etc.), DUPONT CORDURA, canvas (ex., heavy duck canvas, No. 8 natural canvas, No. 6 natural canvas, etc.), polyester (ex., heavy-duty water resistant 600 denier RIPSTOP polyester, double-layered 600×300 denier polyester, etc.), SPUNTUFF water resistant material, durable molded bio-foam, molded HMW polyethylene (ribbed or unribbed), leather, saddle leather, split leather, plastic, vinyl, polypropylene fabrics, polyethylene fabrics, polyolefin fabrics, plastic blends, and/or combinations of the foregoing.

Although the preferred embodiment of the present invention contemplates the provision of a substantially rigid bag structure, it should be recognized that bag 10 may be manufactured from underframes that enable collapsibility of bag 10, such as, for exemplary purposes only, vinyl wiring, nylon roping, and the like, wherein a soft outer fabric shell would then preferably be selected to function as outer body 20.

Figure 2:
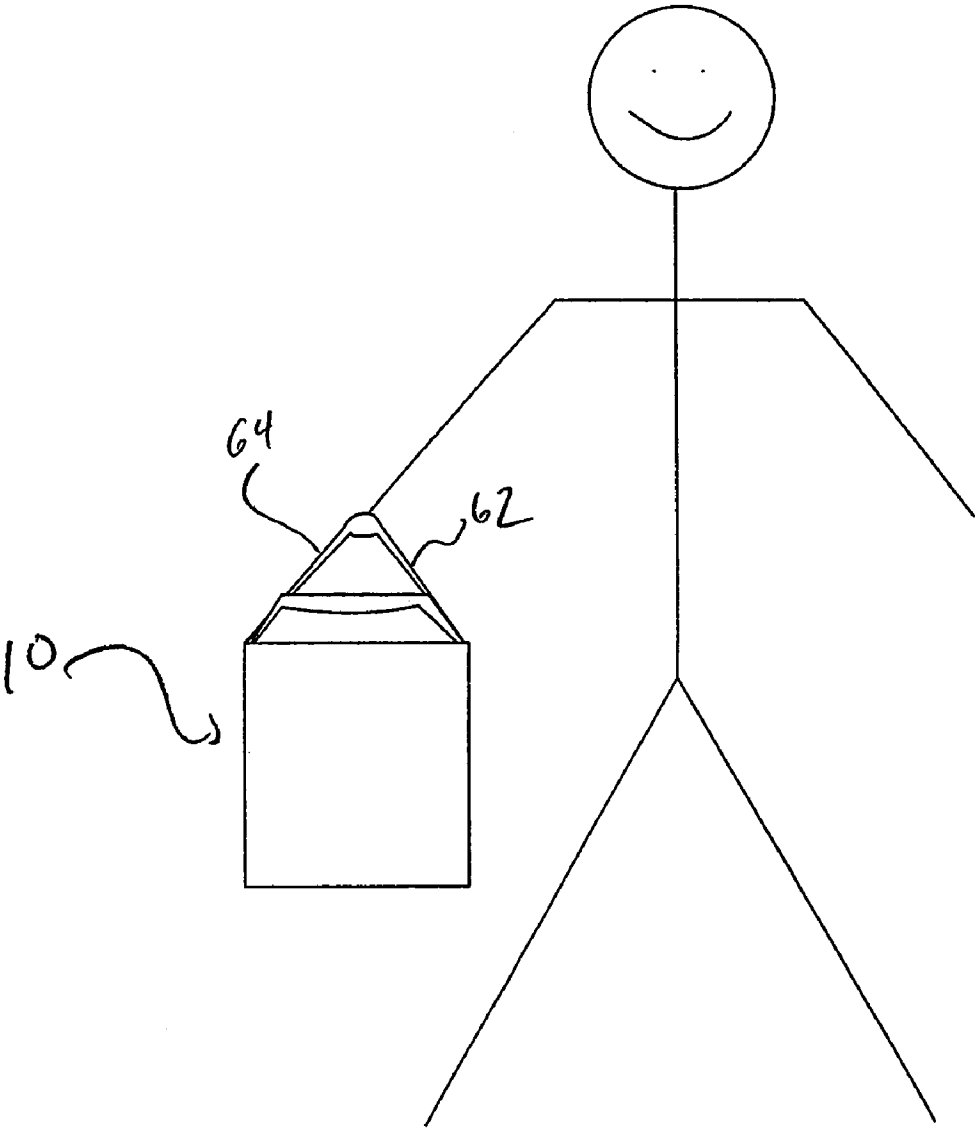
FIG. 2 is a front view of a multi-handle utility bag, shown in use.

Preferably secured to and extending from sidewalls 22, 26 of bag 10, proximate respective peripheral lips 23, 27, are handles 62, 64, respectively, of first pair of handles 60. Preferably, handles 62, 64 are formed from a pliable, high-load capacity fabric, such as, for exemplary purposes only, polypropylene (ex., 2" wide, 900 lb-test, polypropylene), nylon webbing, fabric-covered metal mesh, and the like; however, substantially rigid substrates may alternatively be utilized to form handles 62, 64. Handles 62, 64 further comprise non-slip, ergonomic rubber gripping pads 62*a*, 64*a*, respectively, for facilitating secure grasping and handling of bag 10. Furthermore, terminal ends 62*b*, 64*b* of handles 62, 64 are preferably stitched, riveted or otherwise secured to respective sidewalls 22, 26, and/or respective peripheral lips 23, 27, of bag 10. As best illustrated in FIG. 2, handles 62, 64 are preferably utilized for convenient single-person carriage of the bag.

Preferably disposed proximate to sidewalls 24, 28 are handles 82, 84, respectively, of second pair of handles 80, wherein handles 82, 84 are each preferably secured to and extend between sidewalls 22, 26 of bag 10, proximate respective peripheral lips 23, 27 thereof. Handles 82, 84 are preferably formed from a substantially rigid, molded substrate, such as, for exemplary purposes only, anodized aluminum, anodized steel, anodized metals generally, powder-coated aluminum, powder-coated steel, powder-coated metals generally, molded rubber, hardened rubber, plastic, rubber-coated metal, and the like; however, pliable fabrics or other substrates may alternatively be utilized to form handles 82, 84. Handles 82, 84 similarly comprise non-slip, ergonomic rubber gripping pads 82*a*, 84*a*, respectively, for facilitating secure grasping and handling of bag 10. Additionally, terminal ends 82*b*, 84*b* of handles 82, 84 are preferably riveted 85 or otherwise secured to respective sidewalls 22, 26, and/or respective peripheral lips 23, 27, of bag 10.

Figure 3:
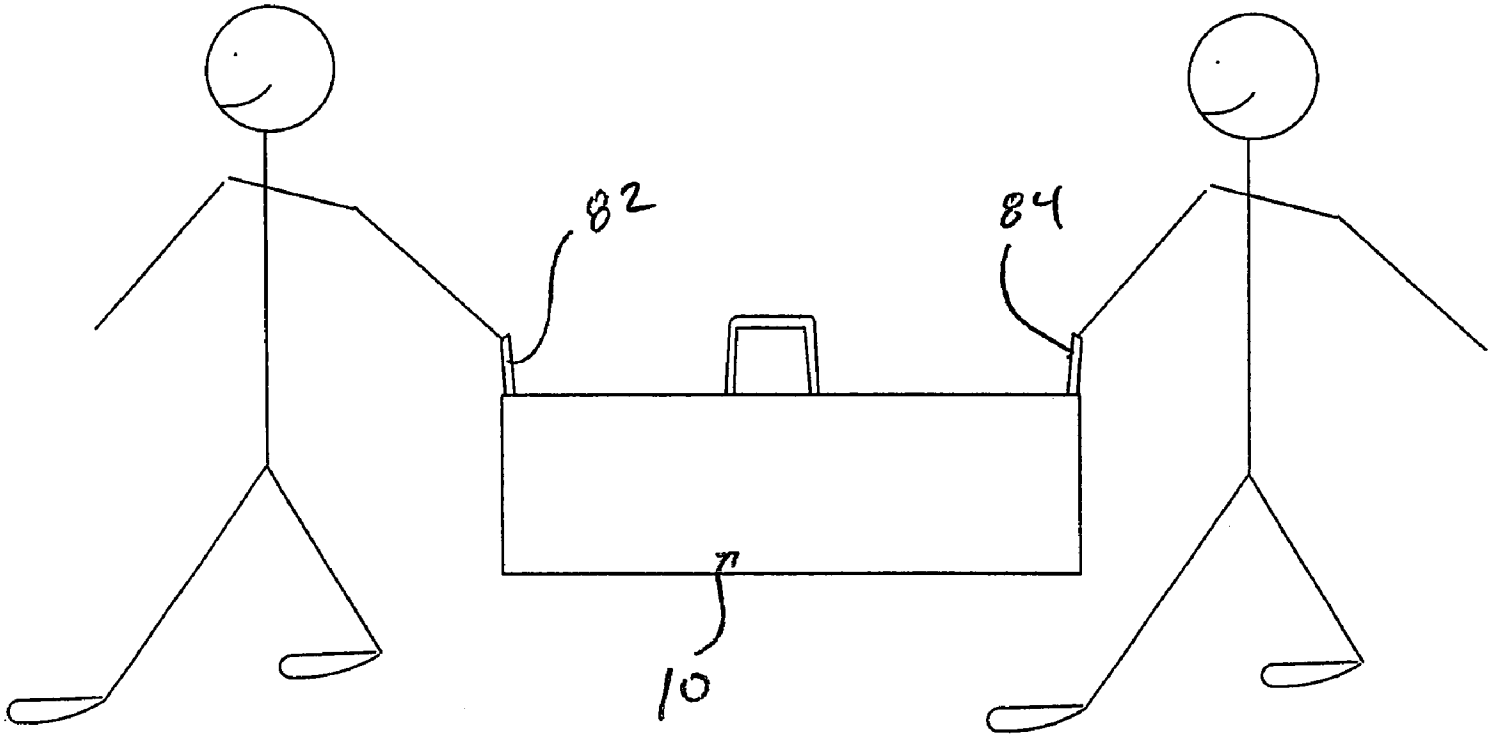
FIG. 3 is a side view of a multi-handle utility bag, shown in use.
Figure 4:
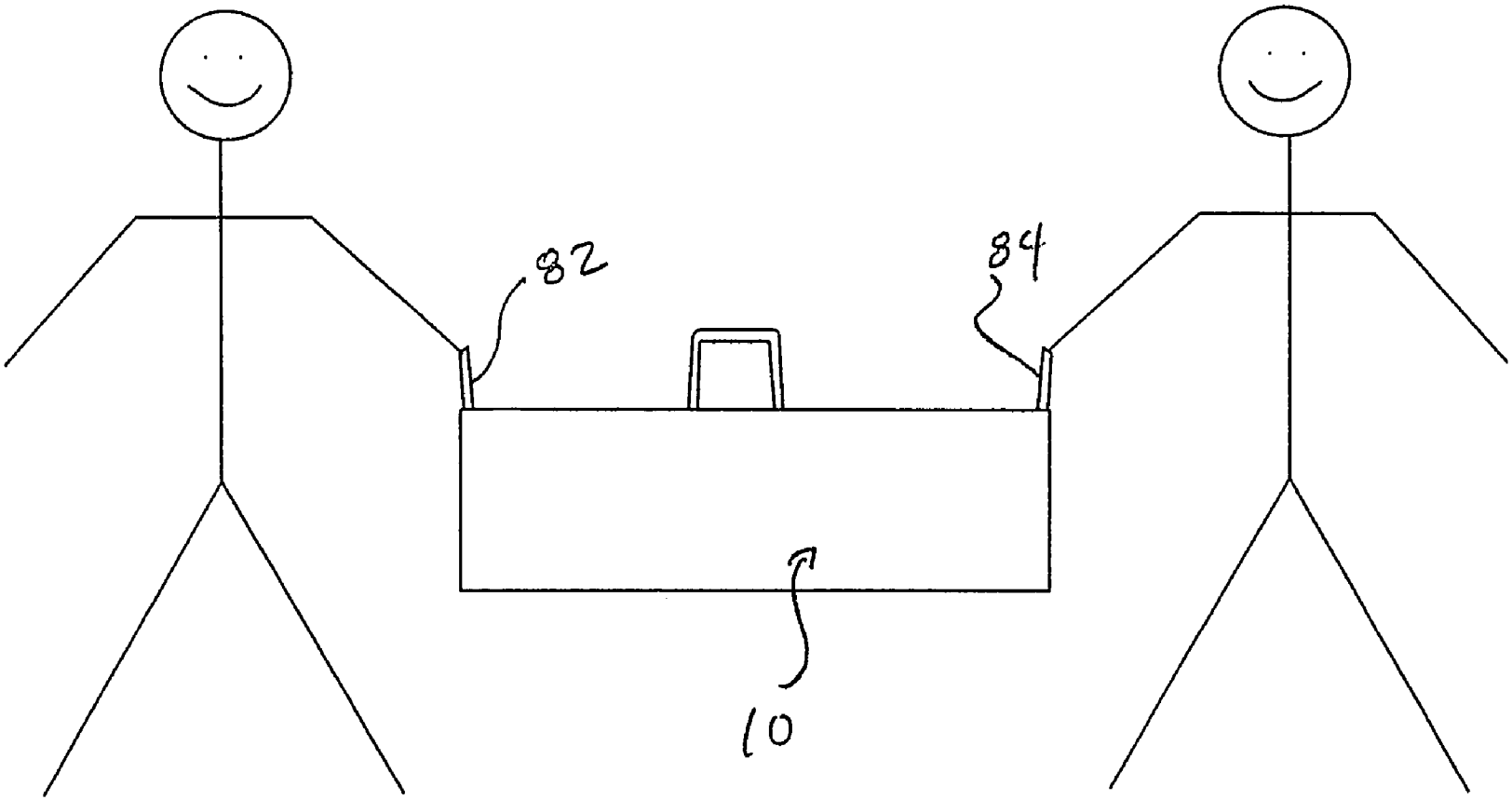
FIG. 4 is a side view of a multi-handle utility bag, shown in use.

As best illustrated in FIGS. 3-4, handles 82, 84 are preferably utilized for multi-person carriage of bag 10. That is, when utility bag 10 has be heavily loaded, such that at least two individuals are now required to lift and transport same, second pair of handles 80 may be utilized by these individuals to accomplish the task. As such, the two individuals may each grasp one of handles 82, 84, wherein the two individuals may be positioned in either a forward-to-rearward fashion (i.e., in-line; see FIG. 3) and either face away or face each other, or an adjacent fashion (i.e., side-by-side; see FIG. 4), during carriage of bag 10. In instances where side-by-side carriage of bag 10 is employed, bag 10 may be carried such that a first handle (ex., handle 82) of second pair of handles 80 is grasped within. the right hand of the first individual, and the second handle (ex., handle 84) of second pair of handles 80 is grasped within the left hand of the second individual. However, it should be recognized that users of the present invention are not limited to carriage of utility bag 10 in accordance with the foregoing methods of transport, but, instead, may employ any method of transport or carriage of the present utility bag 10 that best suits the user's physical circumstances.

Utility bag 10 still further provides a series of pockets 100 disposed over sidewalls 22, 24, 26, 28, wherein pockets 100 may include, without limitation, open pockets 102, pre-form or heat molded open pockets 104, flap-covered pockets 106, and may still further include collapsible pockets, side compartments, pockets and slots of varying size, securing loops, and the like. Additionally, bungee-straps 108 securely disposed overtop selected pockets 100 are provided for removably-securing loose items therewithin. Bag 10 may further optionally comprise any number or series of interiorly-disposed pockets, compartments and other structures for convenient containment of miscellaneous loose hardware (i.e., drill bits, nails, small hand tools, etc.).

Additionally, preferably disposed about the bottom corner edges of underside 32 of bag 10 are non-slip or rubberized gripping feet 110 for securely maintaining bag 10 in a selected position or location over a floor surface, and to further elevate underside 32 from the floor surface so as to prevent possible soilage thereof.

It is contemplated in an alternate embodiment that underside 32 of bag 10 may comprise drain holes to prevent water retention therewithin or thereover.

It is contemplated in another alternate embodiment that bag 10 may comprise a storable top cover receivable over bag mouth 30; thereby, providing protection of bag 10 contents from the elements.

It is contemplated in still another alternate embodiment that bag 10 may comprise a contoured, padded, slip-resistant shoulder strap for hands-free mobility of bag 10.

It should be recognized that. although the present invention contemplates the application of the multi-handle system described herein to the durable and rugged utility bag 10 hereof, it is contemplated that any soft or hard bag structure may be suitably equipped with the arrangement or configuration of handles 62, 64, 82, 84 described hereinabove. Additionally, beyond those described herein, the present invention further contemplates the application of additional handles and/or pairs of handles to bag 10, such as rigid handles extending perpendicular from sidewalls 22, 24, 26, and/or 28.

Having thus described the preferred and selected alternate embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A multi-handle utility bag, comprising:

a rigid underframe;

an outer body formed or disposed over the underframe, the outer body and the underframe together forming a substantially rectangular structure having a pair of short sidewalls, a pair of long sidewalls, an open mouth, and a rigid closed bottom;

a first pair of handles that enables single-person carriage of the bag, the first pair of handles being pliable and being secured to and extending from peripheral lips of the pair of long sidewalls respectively; and a second pair of handles that enables two-person inline or side-by-side carriage of the bag, the second pair of handles being rigid and being secured to and extending from peripheral lips of the pair of short sidewalls respectively.

2. The multi-handle utility bag of claim 1, wherein the first pair of handles comprises a first strap connected to a first sidewall of said multi-handle utility bag and a second strap connected to a second sidewall of said multi-handle utility bag.

3. The multi-handle utility bag of claim 2, wherein the second pair of handles comprises a first rigid handle connected to a third sidewall of said multi-handle utility bag and a second rigid handle connected to a fourth sidewall of said multi-handle utility bag.

4. The multi-handle utility bag of claim 2, wherein said second strap is diametrically-opposed to said first strap.

5. The multi-handle utility bag of claim 3, wherein said first strap and said second strap are configured to be grasped together in a hand of a user.

6. The multi-handle utility bag of claim 3, wherein said second rigid handle is diametrically-opposed to said first rigid handle.

7. The multi-handle utility bag of claim 5, wherein said first sidewall is arranged parallel to and spaced from said second sidewall, wherein said third sidewall is arranged parallel to and spaced from said fourth sidewall, and wherein each of said first sidewall, said second sidewall, said third sidewall, and said fourth sidewall extends generally perpendicularly from the rigid closed bottom of said multi-handle utility bag to define a cavity.

8. The multi-handle utility bag of claim 7, wherein each of said first strap, said second strap, said first rigid handle, and said second rigid handle are disposed proximate respective portions of said first sidewall, said second sidewall, said third sidewall, and said fourth sidewall opposite said bottom.

* * * * *